United States Patent [19]

Russell

[11] 4,376,363

[45] Mar. 15, 1983

[54] ENVELOPE PROCESSING MACHINE HAVING VISUAL PROCESSING VERIFICATION MEANS

[75] Inventor: Robert J. Russell, Medford, N.J.

[73] Assignee: Mail-Ex Corporation, Skokie, Ill.

[21] Appl. No.: 266,075

[22] Filed: May 21, 1981

Related U.S. Application Data

[63] Continuation of Ser. No. 73,014, Sep. 6, 1979, abandoned.

[51] Int. Cl.[3] ..... B65B 43/30; B65B 57/18

[52] U.S. Cl. ..... 53/52; 53/53; 53/266 A; 53/381 R

[58] Field of Search ..... 53/53, 381 R, 390, 52, 53/266 A; 209/588, 938, 900; 250/223

[56] References Cited

U.S. PATENT DOCUMENTS

| | | | |
|---|---|---|---|
| 1,094,672 | 4/1914 | Millentz | 209/938 |
| 1,514,281 | 11/1924 | Grubb | 209/938 |
| 1,551,968 | 9/1925 | Naito | 209/938 X |
| 2,186,196 | 1/1940 | Haugh | 209/588 X |
| 2,351,888 | 6/1944 | Stewart | 53/508 X |
| 2,613,808 | 10/1952 | Richard | 209/938 |
| 2,807,977 | 10/1957 | Zwaaf | 209/938 |
| 3,398,574 | 8/1968 | Bloomer | 53/508 X |
| 3,724,162 | 4/1973 | Lorenzini | 53/508 X |
| 3,979,884 | 9/1976 | Russell | 53/381 R |
| 4,016,708 | 4/1977 | De Hart | 53/381 R |

*Primary Examiner*—John Sipos

*Attorney, Agent, or Firm*—Trexler, Bushnell & Wolters, Ltd.

[57] ABSTRACT

There is disclosed a new and improved envelope processing machine. The machine includes a processing station arranged to present each envelope in an opened condition to an operator in one-by-one relation to facilitate the removal of contents from or the insertion of materials into the envelopes by the operator. A detecting means downstream from the processing station acts upon the envelopes one at a time for sensing a predetermined event corresponding to the suspected absence of complete removal of the contents from or complete insertion of materials into the envelopes. An illumination means actuable in response to the detecting means sensing the predetermined event is arranged to direct light through the envelopes to afford visual verification of the predetermined event by the operator.

12 Claims, 5 Drawing Figures

ENVELOPE PROCESSING MACHINE HAVING VISUAL PROCESSING VERIFICATION MEANS

This application is a continuation of application Ser. No. 073,014, filed Sept. 6, 1979, now abandoned.

BACKGROUND OF THE INVENTION

The present invention relates to a new and improved envelope processing machine, and more particularly to a processing machine which facilitates the manual removal of contents from or the manual insertion of materials into the envelopes by an operator and which includes visual verification means to afford visual verification by the operator of suspected incomplete envelope processing.

Envelope processing machines are known in the prior art wherein envelopes are removed from a supply hopper, transmitted to a cutting station where one edge of the envelope is cut open, and then transmitted to a removal station wherein the envelope is opened and the contents are mechanically extracted. One such machine is described, for example, in West, U.S. Pat. No. 3,384,252. The present invention provides for the manual removal or insertion of the contents of an envelope at the processing station, thus avoiding the complexity and problems incident to the operation of mechanical processing means.

Envelope processing machines were also known in the prior art wherein envelopes are removed from a supply hopper, severed along one edge at a cutting station, and transmitted to a station whereat the envelope is opened and held open for manual removal of the contents. Such a machine is fully described and claimed in U.S. application Ser. No. 801,454 filed May 31, 1977, now U.S. Pat. No. 4,159,611, which is assigned to the assignee of the present invention. The machine there described includes a plurality of reciprocating arms with each arm terminating with a suction cup coupled to a source of negative air pressure. One such arm is located at the envelope hopper where the suction cup engages the envelopes one at a time and pulls the envelopes to a conveyor. The suction cup is able to grip the envelopes due to the air suction at the suction cups. Similarly, a pair of such arms are located at the processing station with each arm having a suction cup arranged to engage respective opposite side panels of the envelopes for gripping and separating the side panels to dispose the envelopes in an open condition to an operator. Again, the suction of the suction cups facilitates the gripping of the envelope side panels.

In addition to the foregoing, the above mentioned envelope processing machine includes a candler device located at the end of the conveyor which includes a light source and a light sensitive element which are spaced apart for receiving the envelopes therebetween as the envelopes exit the processing station. The light sensitive element senses the intensity of the light from the light source which passes through the envelope. When the light intensity received by the light sensitive element is below a predetermined intensity, incomplete removal of the contents from the envelope is suspected and responsive to such detection, operation of the machine is halted and a small alert light is lit to notify the operator of the suspected incomplete removal of the contents. To insure that all of the contents are removed from each envelope before the envelopes are discarded, the candler device is set so as to function conservatively. in other words, the candler device is set so that it will cause machine operation interruption and the warning light to be lit more often than is actually necessary.

Although the aforementioned envelope processing machine has met with considerable success in facilitating the manual removal of contents from envelopes, it has been found in practice that when the candler device detects the presence of unremoved contents from an envelope and interrupts the operation of the machine and lights the warning light, it is necessary for the operator to manually pick up the envelope, part the side walls of the envelopes, and look inside to verify whether all of the contents have been removed therefrom. Obviously, this manner of verifying the accuracy of the candler device reduces the speed in which envelopes are processed. Not only must the operator physically open the envelope to see whether all of the contents have been removed therefrom, but additionally, during the time in which the operator performs this verification function, the machine is held stationary and not processing envelopes.

It is therefore an object of the present invention to provide a new and improved envelope processing machine.

It is a more particular object of the present invention to provide an envelope processing machine which facilitates the manual removal or insertion of materials of an envelope which includes a detecting means for detecting the incomplete processing of the envelopes and a means by which the suspected incomplete processing of an envelope may be readily verified.

It is a still further object of the present invention to provide a new and improved envelope processing machine wherein the suspected incomplete processing of an envelope may be visually verified by an operator without requiring the operator to physically open the envelope and view inside.

The invention therefore provides a machine for processing envelopes which includes a processing station arranged to present each envelope in an opened condition to an operator in one-by-one relation to facilitate the removal of contents from or the insertion of materials into the envelopes by the operator. The machine further includes detecting means for acting upon the envelopes one at a time for sensing a predetermined event corresponding to suspected incomplete removal of the contents from or incomplete insertion of materials into the envelopes, and illumination means actuable in response to the detecting means sensing the predetermined event for directing light through the envelopes to afford visual verification of the predetermined event by the operator.

BRIEF DESCRIPTION OF THE DRAWINGS

The features of the present invention which are believed to be novel are set forth with particularity in the appended claims. The invention, together with further objects and advantages thereof, may best be understood by making reference to the following description taken in conjunction with the accompanying drawings, where, in the several figures like reference numerals identify identical elements, and wherein:

DESCRIPTION OF THE PREFERRED EMBODIMENT

Figure 1:
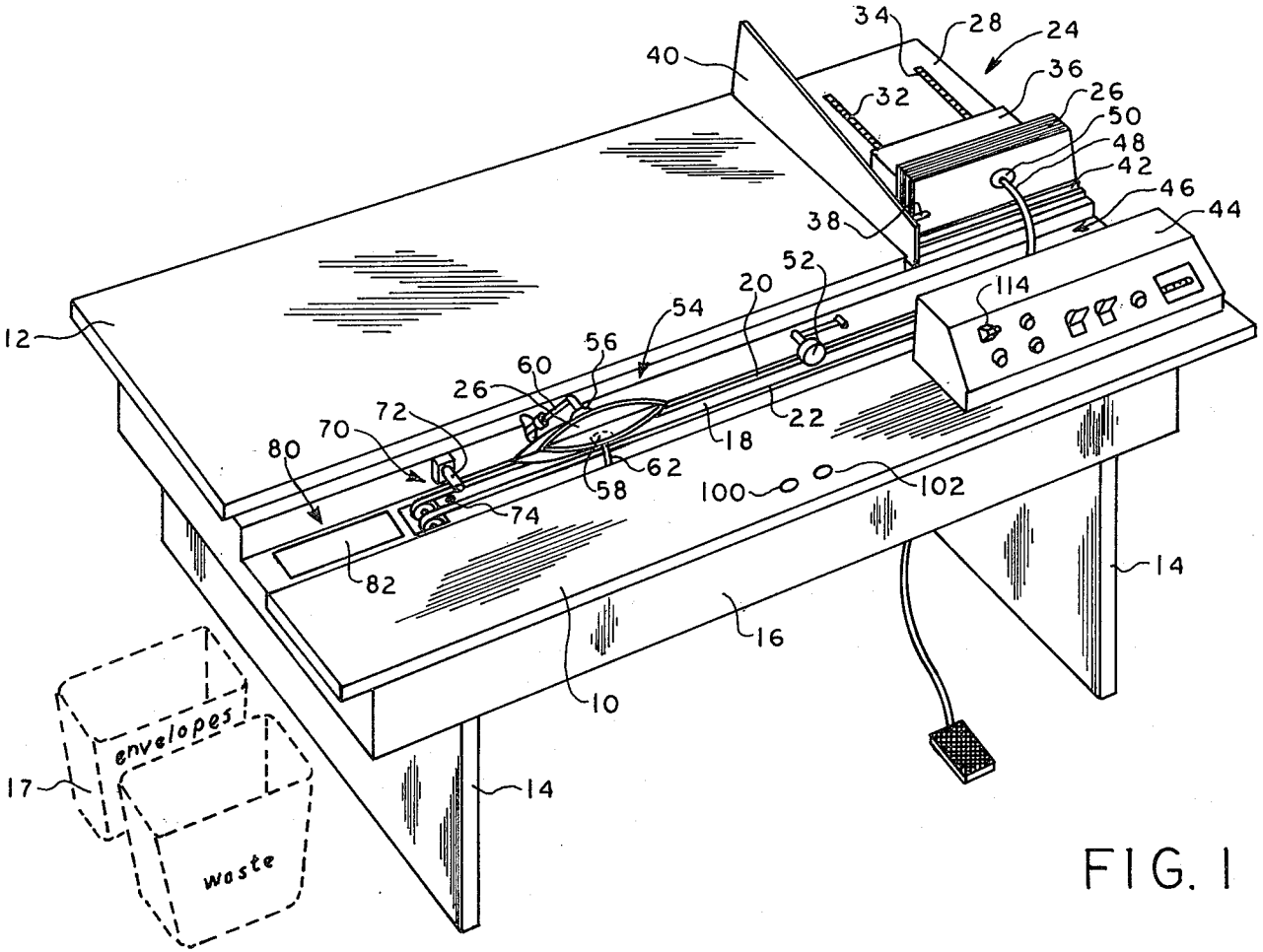
FIG. 1 is a general perspective view showing the machine of the present invention in accordance with one selected embodiment thereof.

Referring now to FIG. 1, the envelope processing machine thereshown constructed in accordance with the present invention generally includes lower and upper offset table structures 10 and 12 supported at table height by legs 14. The upper table 12 covers the internal mechanism of the machine and conveniently provides a work and table surface. The operator sits facing the lower table surface 10 and the front panel of the machine indicated by reference numeral 16. Between the upper table 12 and lower table 10 there is disposed a substantially horizontal plate 18 which extends across substantially the entire width of the machine. The plate 18 supports a pair of endless conveyor belts 20 and 22 which form an envelope transmitting means for conveying the envelopes to be processed from one station of the machine to the next in succession.

To the right of the upper table surface 12 there is provided a supply hopper 24 arranged to contain a plurality of envelopes 26 to be processed. The hopper 24 includes an inclined surface 28, a pair of endless belts 32 and 34 arranged to travel along the surface 28, a weight block 36, and a retainer 38 which projects in the direction of the envelopes 26 from a side abuttment plate 40. The envelopes 26 are arranged in stacked relationship and held in that position against the abuttment plate 40 by the coaction of the retainer 38, the weight 36, and an upwardly projecting lip 42 of the surface 28.

Between the hopper 24 and the control box 44 of the machine there is provided a feed means 46 which includes a reciprocating arm 48 and an envelope gripper 50. As fully described in the aforementioned U.S. Pat. No. 4,159,611, the gripper 50 comprises a suction cup which is connected to a source of negative air pressure by the reciprocating arm 48. As a result, the air suction at the suction cup causes the envelope to be gripped by the feed means 46. The arm 48 is arranged to pivot from a retracted position whereat the gripper 50 is beneath the plate 18 to the illustrated position in FIG. 1 for gripping the envelopes 26 one at a time and placing the envelope onto the conveyor belts 20 and 22. As the arm 48 pivots to its retracted position, the envelope held by the gripper 50 is pulled free of the retainer 38 and downwardly to the conveyor. As the feed means 46 operates, the belts 32 and 34 travel along the inclined surface 28 and the weight 36 descends along the inclined surface 28 to provide a continuous supply of stacked envelopes 26 for the feed means 46.

Once the envelopes are placed upon the conveyor, they are transmitted, one at a time, to the left as seen in the figure to a rotary cutting blade (not shown) which severs the envelopes along an edge thereof. Immediately after being severed by the rotary blade, the envelopes are then conveyed by the belts 20 and 22 to the processing station whereat the envelopes are opened and retained in an opened position to afford ready extraction of the contents therein by an operator. In being so conveyed, the envelopes are caused to pass beneath a pressure roller 52 which assures firm engagement of the envelopes with the belts 20 and 22.

The envelope processing station 54 includes an envelope opening means comprising a pair of envelope grippers 56 and 58 which are substantially identical to the gripper 50 of the feed means 46. The grippers 56 and 58 are carried by reciprocating arms 60 and 62 respectively which also serve to connect the grippers 56 and 58 to a source of negative air pressure. Also as described in the aforementioned U.S. Pat. No. 4,159,611, the arms 60 and 62 are arranged for reciprocal movement so as to cause the grippers 56 and 58 to engage and separate the opposing side panels of the envelope 26 to thereby present the envelopes to the operator in an opened condition as illustrated. When the envelope is so positioned, the machine may be set by the control box 44 to have a preset dwell time whereby the envelope is remained opened for a sufficient period of time to facilitate manual extraction of the contents therefrom by an operator.

Now that the envelope has been opened, its contents removed, and once again placed upon the belts 20 and 22, the envelope is caused to be conveyed to a detecting station 70 which detects a predetermined event corresponding to the presence of unremoved contents within the envelope. The detecting station 70 includes a detecting means taking the form of a candling mechanism comprising a light source 72 and a light sensitive element or photocell 74. The light source 72 and photocell 74 are spaced apart for receiving the envelope therebetween. The detecting station 70 operates in such a manner that when the light reaching the photocell 74 from the light source 72 passing through the envelope is of an intensity below a predetermined intensity, as for example when contents from an envelope have been overlooked or otherwise not removed, the machine will index by operating the belts 20 and 22 to convey the envelope to an illumination station 80 and thereafter stop until being reset by the operator depressing a reset switch 100. After the machine conveys the envelope to the illumination station 80 and thereafter stops, the illumination station 80 will be actuated responsive to the detecting station 70 sensing the predetermined event corresponding to incomplete envelope processing, as, for example, the presence of unremoved contents from an envelope.

Figure 2:
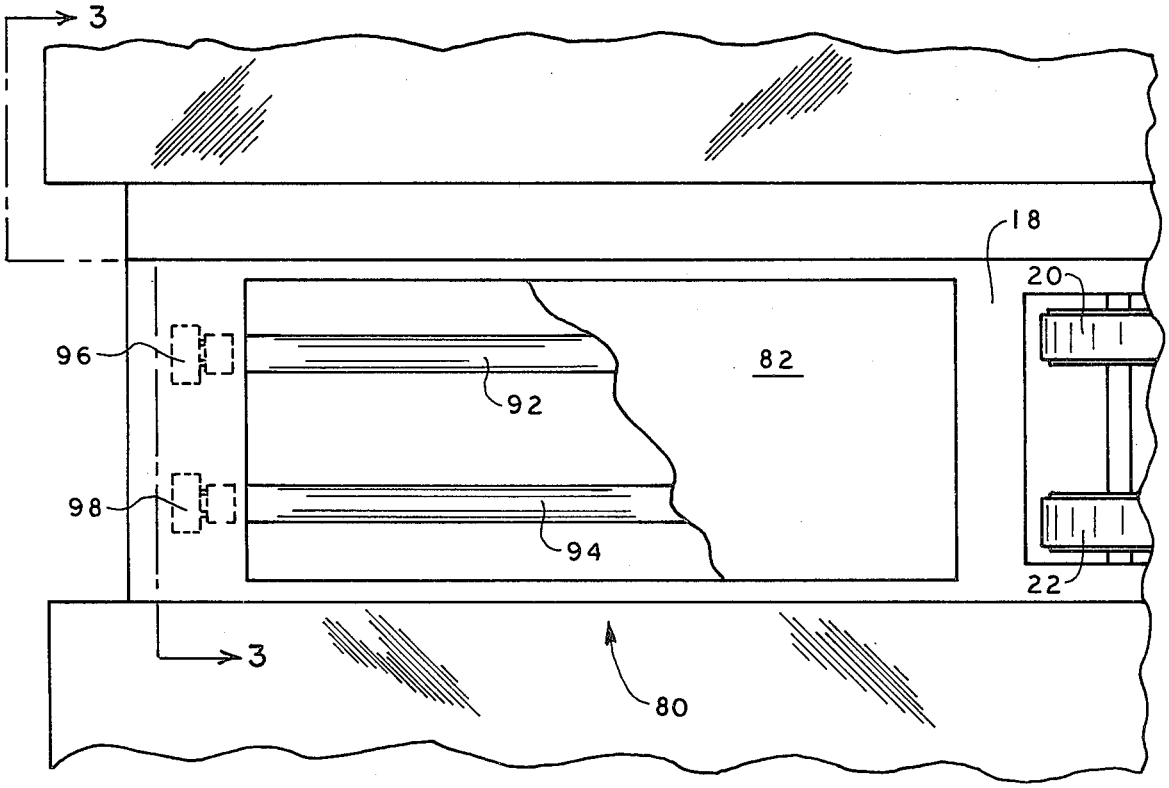
FIG. 2 is a partial top plan view to an enlarged scale with portions cut away of the machine of FIG. 1 particularly showing an envelope processing verification means embodying the present invention.
Figure 3:
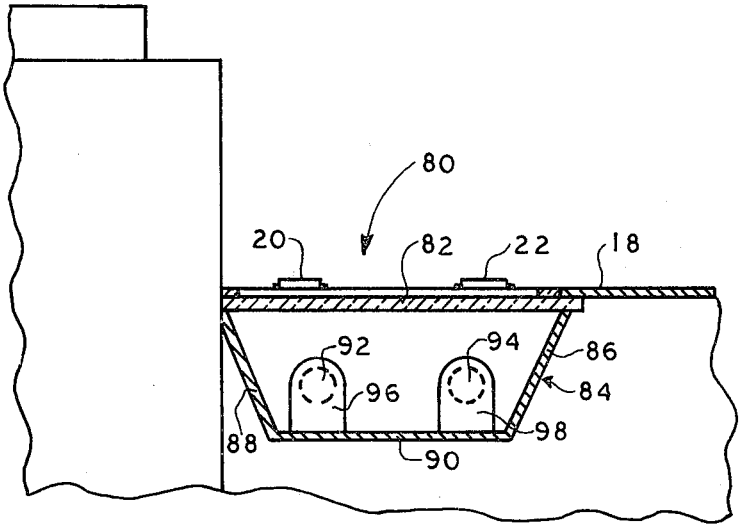
FIG. 3 is a partial cross sectional side view taken along lines 3—3 of FIG. 2.

Referring now to FIGS. 2 and 3, it can be noted that the illumination station includes a light transmissive top plate 82 extending beneath and substantially parallel to the top plate 18 adjacent to the belts 20 and 22 of the conveyor. The top plate 82 may be formed from, for example, clear glass, frosted glass, or the like. Beneath the top plate 82 is provided a housing 84 which includes a pair of sidewalls 86 and 88 and a bottom wall 90. Within the housing 84 there is provided a light source comprising, for example, a pair of instant-an florescent lights which are mounted to the bottom wall 90 by a first pair of socket fixtures 96 and 98 respectively and a second pair of such sockets (not shown) at the opposite end of the housing 84.

The interior surfaces of the walls 86, 88 and 90 of the housing 84 preferably include a reflective coating. As a result, when the florescent bulbs 92 and 94 are actuated, the light which they emit will be directed upwardly through the envelope which has been received thereon.

Figure 4:
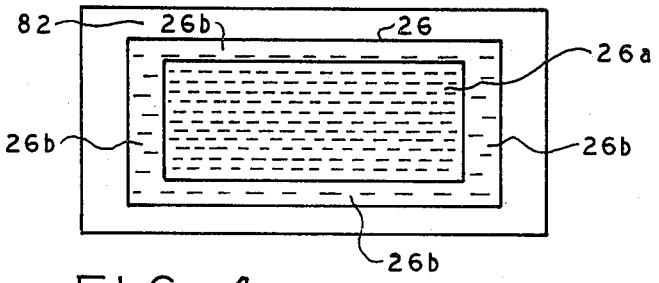
FIG. 4 is a top plan view of the verification means of the present invention showing the operation thereof in verifying the presence of detected unremoved contents of an envelope.

FIG. 4 illustrates the operation of the illumination station 80 in verifying the presence of unremoved contents from an envelope as detected by the detecting station 70. As can be seen in the figure, the envelope 26 has been deposited upon the top surface of the plate 82. Because the light from the florescent bulbs 92 and 94 is directed upwardly through the plate 82, the outline of the envelope 26 may be readily viewed. More importantly, because less light will be transmitted through the unremoved contents 26*a* within the envelope, the surface area of the envelope overlying the unremoved contents 26*a* will appear darker than the margins 26*b* between the periphery of the unremoved contents 26*a* and the periphery of the envelope 26. As a result, the presence of the unremoved contents 26*a* within the envelope 26 as detected by the detecting station 70 may be readily and visually verified by the operator without requiring the operator to manually open the envelope and view inside.

Of course, should the light passing through the envelope 26 be of uniform intensity over the entire envelope, the operator will know that all of the contents have been removed and that the detecting station 70 was in error. After verifying the presence of the unremoved contents within the envelope, the operator then must, of course remove the unremoved contents and then deposit the envelope into the appropriate receptacle 17 provided at the end of the machine.

Once the presence or absence of unremoved contents within the envelope has been dealt with, the operator may resume operation of the machine by depressing the reset switch 100. As will be clear subsequently, another switch referred to herein as a set switch or "when in doubt" switch 102 is provided so that the operator may simulate the control signal provided by the detecting station 70 upon sensing the predetermined event. As a result, a manual set is provided by which the operator may initiate verification even though the detecting station 70 did not detect incomplete processing of an envelope. In simulating the operation of detecting station 70 by depressing the set switch 102, the machine will operate in the previously described manner by indexing the envelope suspected by the operator of receiving incomplete processing to the illumination station 80. Thereafter, visual verification of the envelope may be performed in the previously described manner until the reset switch 100 is again depressed.

Figure 5:
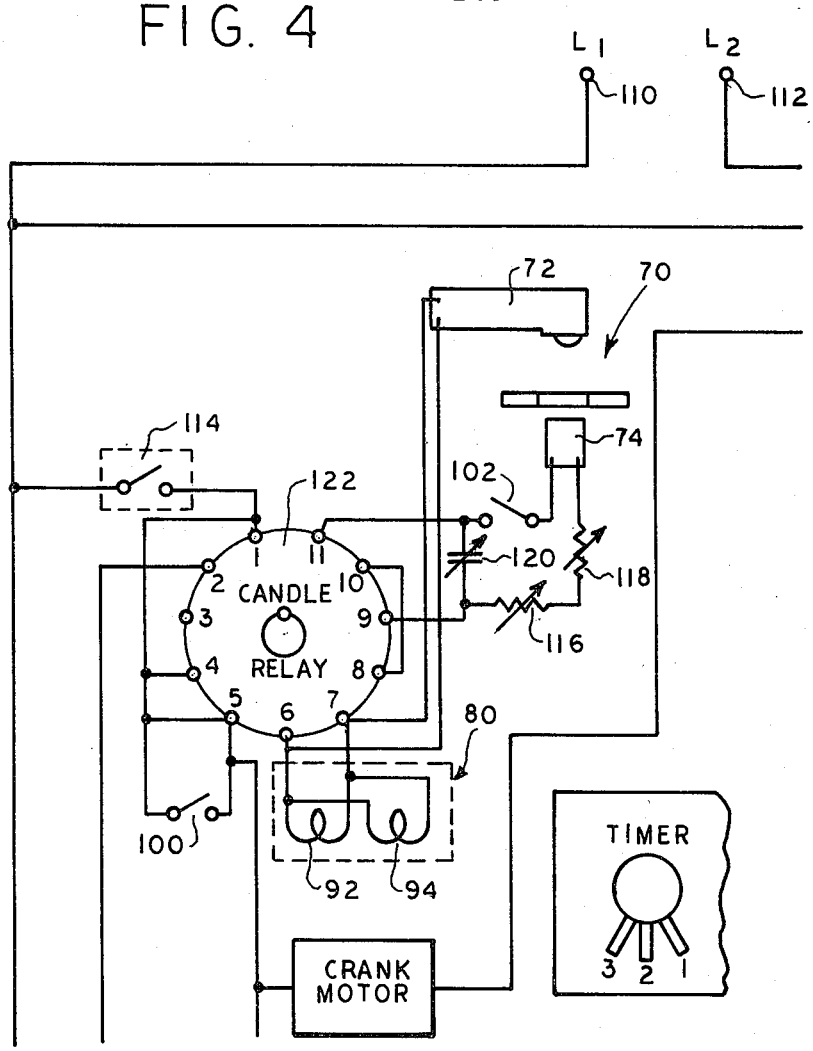
FIG. 5 is a partial schematic wiring diagram of the candling mechanism and verification means embodying the present invention.

Referring now to the schematic wiring diagram of FIG. 5, a pair of terminals 110 and 112 are adapted for connection to an AC power source. The candling mechanism, in addition to the light source 72 and the photocell 74 includes an on-off switch 114, a primary variable resistor 116, a secondary variable resistor 118, a variable capacitor 120, and a candler mechanism relay 122. The circuit of FIG. 5 also includes the reset switch 100, the set switch 102, and the florescent light bulbs 92 and 94 of the illumination station 80. Although the set switch 102 is shown in an opened condition, the set switch 102 is preferably a normally closed switch which, unless depressed, is in the condition as illustrated by the dashed lines. Additionally, for a complete schematic wiring diagram illustrating the remaining electrical connections associated with the machine of the present invention, reference may be had to the previously mentioned patent application Ser. No. 801,454.

The candler relay 122 preferably has a built in delay so that when the light reaching the photocell 74 drops below a predetermined intensity, as for example when contents from an envelope have been overlooked or otherwise not removed, the increased resistance thereby introduced into the control circuit by the photocell 74 will cause the candler relay to allow the machine to index for depositing the envelope onto the illumination station and thereafter cut off the power supply and immediately stop the machine. Additionally, when the machine is stopped, the candler relay 122 will cause the florescent bulbs 92 and 94 of the illumination station 80 to be actuated. To vary the critical control resistance, to accommodate for envelopes of different thicknesses and character of paper, a primary voltage resistor 116 is provided for major adjustment, and a second variable resistor 118 is provided for secondary or micrometer adjustment. Also, so that the machine will not be stopped at the double thickness of the relatively narrow seams of the envelope as it passes the photocell 74, the variable capacitor 120 is provided, so that the transitory fluctuation due to such envelope seams will not interrupt the operation of the machine.

After an improperly emptied envelope is retrieved and acted upon by the operator, the reset switch 100 is actuated to turn off the florescent light bulbs 92 and 94 of the illumination station 80 and restore operation of the machine. When the operator wishes to manually simulate the detector station and provide the high resistance control signal normally provided by the photocell 74 of the detecting station 70, the operator depresses the set switch 102 so as to open the set switch 102. When the set switch is opened, the increased resistance introduced into the control circuit by the opening of the switch 102 will cause the machine to act as previously described for indexing the envelope onto the illumination station, for stopping the machine, and for actuating the illumination means.

While this preferred embodiment has been generally directed to an envelope processing machine which facilitates the manual removal of contents from envelopes, it can of course be appreciated that the present invention is not so limited, and, in fact, is also particularly adapted for use in an envelope processing machine which facilitates the manual insertion of materials into envelopes as well. For either type of envelope processing machine, it can be seen from the foregoing that the present invention provides a new and improved envelope processing machine whereby the incomplete removal or insertion of contents of envelopes may be readily verified by an operator. More particularly, such a condition may be visually verified by the operator without requiring the operator to manually open and view into the suspected envelope.

While a particular embodiment of the present invention has been shown and described, modifications may be made, and it is therefore intended to cover in the appended claims all such changes and modifications which fall within the true spirit and scope of the invention as defined by said claims.

The invention is claimed as follows:

1. A machine for processing envelopes comprising: a processing station with means for opening an envelope, means for feeding envelopes from a supply in one-by-one relation; conveying means with entry and delivery ends receiving envelopes from the feeding means in underlying support at the entry end of the conveying means in predetermined spaced relation and arranged to present each envelope at the processing station to render the same to an opened condition accessible to an operator in one-by-one relation to facilitate the removal of contents from or the insertion of materials into the envelopes by the operator; detecting means spaced from the processing station in the direction of the delivery end of the conveying means a distance sufficient to allow a previously opened envelope to relax toward closed condition at the detecting means for acting upon the conveyed and relaxed envelopes one at a time for sensing a predetermined event corresponding to suspected incomplete removal of the contents from or incomplete insertion of materials into the envelopes; and illuminating means longitudinally proximate to the delivery end of the conveying means with an associated envelope support surface for receiving therefrom and supporting an envelope generally relaxed from its previously opened condition under the moving contact influence of the conveying means and released from support by the conveying means with sliding arrest on the envelope support surface over the illuminating means in stationary positioning on the envelope support surface independent of the moving contact influence of the conveying means in association with the illuminating means which is actuable in response to said detecting means sensing said predetermined event for directing light through the stationary envelope received in association with the illuminating means to afford visual verification of said predetermined event by the operator and permissive unobstructed handling of the stationary envelope as the predetermined event may dictate.

2. A machine as defined in claim 1 wherein said processing station is arranged to be disabled responsive to said detecting means sensing said predetermined event with continued movement of the conveying means to deposit the sensed envelope in stationary position on the support surface of the illuminating means.

3. A machine as defined in claim 2 further comprising reset means for disabling said illuminating means and enabling said processing station.

4. A machine as defined in claim 1 further including set means for actuating said illuminating means manually by an operator independently of said detecting means.

5. A machine as defined in claim 4 wherein said processing station is arranged to be disabled responsive to said set means.

6. A machine as defined in claim 5 further comprising reset means for disabling said illuminating means and enabling said processing station.

7. A machine as defined in claim 1 wherein said illuminating means comprises a substantially horizontal light transmissive top plate and a light source beneath said top plate, and wherein said conveying means is arranged to convey the envelopes to said top plate for being supported by said top plate.

8. A machine as defined in claim 1 wherein said detecting means comprises a light source and a light sensitive element arranged to receive light from said light source, wherein said light source and said element are spaced apart for receiving the envelopes therebetween, and wherein said detecting means senses said predetermined event when the light from said light source passing through an envelope and received by said element is below a predetermined intensity.

9. A machine which facilitates the removal of contents from envelopes comprising: a processing station with means for opening an envelope, means for feeding envelopes from a supply in one-by-one relation; conveying means with entry and delivery ends receiving envelopes from the feeding means in underlying support at the entry end of the conveying means in predetermined space relation and arranged to present the envelopes in one-by-one relation at the processing station to render the same to an opened condition to facilitate the removal of the contents from the envelopes by the operator; detecting means spaced from the processing station in the direction of the delivery end of the conveying means a distance sufficient to allow a previously opened envelope to relax toward closed condition at the detecting means for sensing the conveyed envelopes for the presence of unremoved contents within the envelope relaxed from its previously opened condition and for providing a control signal responsive thereto; and illumination means longitudinally proximate to the delivery end of the conveying means with an associated envelope support surface and arranged to receive and support the relaxed envelopes under the moving contact influence of the conveying means and released from support by the conveying means with sliding arrest on the envelope support surface over the illumination means in stationary positioning on the envelope support surface independent of the moving contact influence of the conveying means in association with the illumination means after being sensed by said detecting means and actuable responsive to said control signal for directing light through the stationary envelope to afford visual verification by the operator of the presence of the unremoved contents.

10. A machine as defined in claim 9 wherein said processing station is arranged to be disabled responsive to said control signal with continued movement of the conveying means to deposit the sensed envelope in stationary position on the support surface of the illuminating means.

11. A machine as defined in claim 10 further comprising set means for manually generating said control signal for actuating said illumination means and disabling said processing station.

12. A machine as defined in claim 11 further comprising reset means for disabling said illumination means and enabling said processing station.

* * * * *